US011684814B2

(12) United States Patent
Lüttge

(10) Patent No.: US 11,684,814 B2
(45) Date of Patent: Jun. 27, 2023

(54) PLAYGROUND EQUIPMENT WITH ROLLS

(71) Applicant: KOMPAN A/S, Odense SØ (DK)

(72) Inventor: Cathrine Lüttge, Odense SØ (DK)

(73) Assignee: KOMPAN A/S

( * ) Notice: Subject to any disclaimer, the term of this patent is extended or adjusted under 35 U.S.C. 154(b) by 0 days.

(21) Appl. No.: 17/470,752

(22) Filed: Sep. 9, 2021

(65) Prior Publication Data

US 2022/0072358 A1 Mar. 10, 2022

(30) Foreign Application Priority Data

Sep. 10, 2020 (DK) ..... PA202001025

(51) Int. Cl.
*A63G 9/00* (2006.01)
*A63B 9/00* (2006.01)
*A63G 21/00* (2006.01)

(52) U.S. Cl.
CPC ..... *A63B 9/00* (2013.01); *A63B 2009/002* (2013.01); *A63B 2009/006* (2013.01)

(58) Field of Classification Search
CPC ..... A63B 9/00; A63B 19/00; A63B 17/02; A63G 21/00
USPC ..... 472/116; 482/35, 37
See application file for complete search history.

(56) References Cited

U.S. PATENT DOCUMENTS 5,372,550 A * 12/1994 Gleeson ..... A63B 9/00 472/116
5,795,267 A * 8/1998 Weaver ..... A63B 9/00 482/23
2020/0016444 A1 1/2020 Bentsen et al.
2020/0094095 A1 3/2020 Huffman et al.

FOREIGN PATENT DOCUMENTS

| | | | |
|---|---|---|---|
| CN | 205252516 | U | 5/2016 |
| DE | 20310624 | U1 | 11/2004 |
| DE | 202006006528 | U1 | 10/2006 |
| JP | S515900 | A | 1/1976 |
| JP | S5398199 | A | 8/1978 |
| KR | 101232775 | B1 | 2/2013 |

OTHER PUBLICATIONS

European Search Report issued in EP21195706.3, dated Feb. 15, 2022 (5 pages).
Search Report issued in Danish Application No. PA202001025, dated Jan. 26, 2021 (4 pages).

* cited by examiner

*Primary Examiner* — Kien T Nguyen
(74) *Attorney, Agent, or Firm* — Bookoff McAndrews, PLLC

(57) ABSTRACT

A playground equipment comprising an array structure of networked ropes arranged in a rectangular array of parallelly arranged first ropes and intersecting second ropes and one or more rolls connected to a first rope, between two neighbouring second ropes wherein each roll comprises an inner clamping part configured for non-slideable fixation to the respective first rope, and an outer part attachable to the inner clamping part wherein the inner clamping part and the outer part are in non-slideable connection relative to each other and wherein the outer part is rotatable relative to the inner clamping part.

10 Claims, 3 Drawing Sheets

PLAYGROUND EQUIPMENT WITH ROLLS

CROSS-REFERENCE TO RELATED APPLICATIONS

This application claims benefit to Danish Patent Application No. PA202001025, filed on Sep. 10, 2020, which is incorporated herein by reference in its entirety.

TECHNICAL FIELD

The present invention relates to a roll for a playground equipment comprising an array structure of networked ropes comprising parallelly arranged first ropes and intersecting second ropes. The invention further relates to a playground equipment comprising an array structure of parallelly arranged first ropes and intersecting second ropes and one or more rolls formed on one or more of the first ropes. The invention further relates to an array structure of networked ropes of parallelly arranged first ropes and intersecting second ropes with one or one or more rolls formed on one or more of the first ropes, which array structure may form part of a playground equipment. The invention further relates to an array section of an array structure of networked ropes, where at least the array section comprises one or more rolls connected to the first ropes of the array section between each pair of neighbouring second ropes of the array section.

DESCRIPTION OF RELATED ART

Playground equipment comprising an array structure of networked ropes having ropes connected in a rectangular array is known in the art.

Also known in the art is a colouring wall with rolls of differing colours formed on bars. Such colouring walls are known from public and private playgrounds, for example in connection with family restaurants, furniture warehouses, shopping malls, parks etc. In the same setting also known are tic-tac-toe games of boxes, blocks or plates—with two sides X and O—which are slidably and/or rotatably arranged on an array of bars, the tic-tac-toe forming part of a playground equipment.

Also known in the art is playground equipment having rolls with images formed thereon arranged as a vertical wall, and where the rolls may be rotated to form different combinations of images. The rolls are formed on parallel vertical or horizontal bars of a playground equipment.

Such colour walls, tic-tac-toe games and the like are cumbersome to mount in a playground equipment, serve mostly a decorative purpose, and therefore take up large space in a playground equipment. Further, such elements are relatively expensive to make and cannot be added to existing playground equipment, without major reconstruction thereof.

There is therefore a need for playground equipment with rolls that provide increased variety in use, which is safe to use and which may also be easily retrofitted to existing playground equipment.

SUMMARY OF THE INVENTION

The objects of the invention are achieved by a playground equipment comprising a structure of networked ropes arranged in a rectangular array of parallelly arranged first ropes and intersecting second ropes and one or more rolls connected to a first rope between two neighbouring second ropes wherein each roll comprises an inner clamping part configured for non-slideable fixation to the respective first rope, and an outer part attachable to the inner clamping part wherein the inner clamping part and the outer part are in non-slideable connection relative to each other and wherein the outer part is rotatable relative to the inner clamping part.

Thereby, each roll may be attached to the array structure of networked ropes in a very secure way to avoid a user—typically a child—from getting his or her fingers pinched between roll and rope when using the roll, for example rotating the roll, since the roll is prevented from displacing along the axis of the rope.

The invention allows the formation of an array of rolls. The rolls may be coloured in different colours. Thereby, a user, in particular children can turn the rolls to the desired colour to "paint" an image with the rolls.

The playground equipment may further comprise a scaffold structure configured for mounting the array structure of networked ropes in a spread out manner. The scaffold structure may comprise elements in the form of vertical beams, slanted beams, plates, blocs or a combination thereof. The scaffold structure may optionally comprise further elements in the form of horizontally formed beams connected between one or more of the previously mentioned elements. The array structure of networked ropes may be spread out between combinations of the above mentioned elements.

The entire structure of networked ropes or roll array sections thereof may be equipped with such rolls.

In an embodiment of the playground equipment, the array structure of networked ropes arranged in a rectangular array of parallelly arranged first ropes and intersecting second ropes comprises a roll array section formed between a first end first rope and a second end first rope and a first side second rope and a second side second rope, where the first end first rope and the second end first rope and at least one first rope formed there between comprises at least one roll formed between two neighbouring second ropes between the first side second rope and the second side second rope.

Thereby the rotational axes of each roll are essentially parallel. This allows a user to use the roll array section to roll objects along the roll array section in one direction parallel to the second ropes.

The rolls may be coloured in different colours. Thereby, a user, in particular children can turn the rolls to the desired colour to "paint" an image with the rolls.

In some embodiments, the distance between first ropes in at least the roll array section are equidistantly separated from each other. In further embodiments, the distance between second ropes in at least the roll array section are equidistantly separated from each other.

The diameter of the rolls of the roll array section may be adapted to the distance between neighbouring first ropes of the roll array section such that a spacing between two rolls on neighbouring first ropes is smaller than the diameter of the rolls (that are preferably identically dimensioned). Thereby, the roll array section may be used to roll a user over the roll array section, whereby it may be used as a slide.

In preferred embodiments, the distance between first ropes in the roll array section and the second ropes are in the range of 25-50 cm. Thereby, in sections of the array structure of networked ropes neighbouring the roll array section allow a user such as a child to crawl through the lattice structure.

In some embodiments, between each two neighbouring second ropes each first rope of the roll array section has one roll. However, in other embodiments, two or more rolls are connected to each first rope between each neighbouring second ropes of the roll array section.

In further embodiments, an intermediary third rope may be formed between neighbouring first ropes of the roll array section. In one embodiment, the third rope is parallel to the neighbouring first ropes. The intermediary third ropes may be formed only inside the roll array section, i.e. between the first side second rope and the second side second rope. In some embodiments, a single third rope may be formed between each neighbouring first ropes of the roll array section. However, in other embodiments two or three third ropes may be formed between each neighbouring first ropes of the roll array section. In either case, each third rope has at least one roll formed between each neighbouring second ropes of the roll array section.

In some embodiments, between each two neighbouring second ropes, each third rope of the roll array section has one roll. However, in other embodiments, two rolls are connected to each third rope between each neighbouring second ropes of the roll array section.

Preferably, the number of rolls connected to the third ropes between each two neighbouring second ropes, is the same as the number of rolls connected to the first ropes between each two neighbouring second ropes.

Again in these embodiments, the diameter of the rolls of the roll array section may be adapted to the distance between neighbouring first ropes and third ropes of the roll array section such that a spacing between two rolls on neighbouring first ropes is smaller than the diameter of the rolls (that are preferably identically dimensioned). Thereby, a relatively uniform "rolling" surface is provided, which can be used like a slide.

Further, each roll may be provided with one or more colours and/or markings, such that individual rolls or a combination of rolls—relative to their rotational positions may form different patterns for playing or learning purposes.

In an embodiment the inner clamping part of each of the rolls comprises two or more interconnectable inner shell parts.

The inner shell parts may be squeezed together around the rope and connected to each other with barbed fasteners. In one embodiment, the barbed fasteners are arranged in parallel corresponding holes in the inner shell parts.

Thereby, a very easy way of attaching rolls to an array structure of networked ropes is provided.

The inner shell parts may be connected to each other by fastening means such as screws.

The inner clamping part of the roll may be made from two or more identical plastic injection moulded inner shell parts.

In a preferred embodiment the inner clamping part of each of the rolls comprises exactly two interconnectable inner shell parts.

The inner clamping part of each roll may have one or more inner surfaces configured for clamping to the first ropes. The inner clamping part may have one or more inner surfaces configured for clamping to the first ropes. This may e.g. be obtained by the dimension of the one or more inner surfaces being slightly smaller than the outer dimension of the first ropes.

In embodiments, where the inner clamping part comprises two or more inner shell parts, the inner shells parts may have one or more inner surfaces configured for clamping to the first ropes. This may e.g. be obtained by the dimension of the one or more inner surfaces being slightly smaller than the outer dimension of the first ropes.

In other embodiments, the inner clamping part of each roll may be fixed to the first rope by an inner surface of the inner clamping part comprising protrusions configured for depressing portions of the first ropes. In embodiments, where the inner clamping parts comprises inner shell parts the protrusions on the inner surfaces may be distributed on one inner shell part or two or more of the inner shell parts. Such protrusions may in embodiments be knobs. In outer embodiments the protrusions may be small spikes or needles.

In either of the above mentioned embodiments, the outer part of each of the rolls may comprise two or more interconnectable outer shell parts. Thereby, a very easy way of attaching rolls to an array structure of networked ropes is provided. In particular an easy way of assembling an outer part on an inner clamping part is obtained.

The outer shell parts may be connected to each other by fastening means such as screws or barbed fasteners pressed into corresponding holes in abutting outer shell parts.

In a preferred embodiment the outer part of each of the rolls comprises exactly two interconnectable outer shell parts.

In either of the above mentioned embodiments, the inner clamping part of each roll may comprise a circumferential bead or recess, and the outer part of each roll comprises a mating annular recess or bead respectively configured for cooperating with the circumferential bead or recess of the respective inner part.

The cooperating circumferential bead and annular recess allows rotation and prevents sliding in a direction parallel to a longitudinal direction of the first ropes.

In some embodiments, each roll comprises a single cooperating circumferential bead and annular recess. The circumferential bead and cooperating annular recess may for example be located centrally in a longitudinal direction of the roll.

However, in an embodiment, the inner clamping part of each roll comprises a first circumferential bead formed at a first end of the inner clamping part and a second circumferential bead formed at a second end of the inner clamping part, and the outer part comprises a mating annular recess configured for cooperating with the circumferential bead formed at the first end of the inner clamping part and a mating annular recess configured for cooperating with the circumferential bead formed at the second end of the inner clamping part.

It is noted that in either case the bead and the recess may be reversed between the inner clamping part and the outer part.

In addition to either of the above mentioned embodiments, in a further embodiment, an outer surface of each roll comprises two or more surface sections formed in parallel to a longitudinal axis of the first ropes, each surface section having a different colour.

In one embodiment, where the outer part is formed by two or more outer shell part, each having an outer surface, at least the outer surface of each shell part may be provided with a different colour. In a preferred embodiment, where the outer part is formed by two interconnectable outer shell parts, each having an outer surface, the outer surfaces of each of the two or more interconnectable outer shell parts being provided with a different colour.

In some embodiments, the interconnectable outer shell parts are injection moulded and formed in plastic. The different colour outer surfaces, in this case may be provided by the two or more interconnectable outer shell parts being moulded in different colours.

It should be emphasized that the term "comprises/comprising/comprised of" when used in this specification is taken to specify the presence of stated features, integers, steps or components but does not preclude the presence or addition of one or more other features, integers, steps, components or groups thereof.

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

Figure 1:
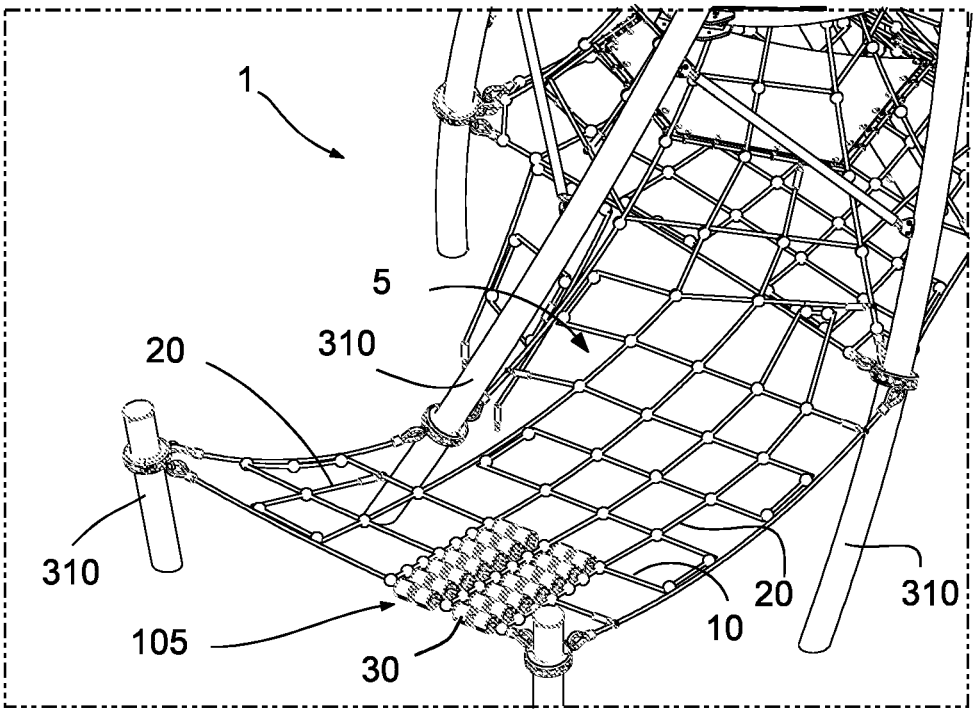
FIG. 1 is a visualisation of an embodiment according to one aspect of the inventive playground equipment, the playground equipment comprising an array structure of networked ropes and a roll array section, the visualization also depicting uses of the playground equipment.

FIG. 1 is a visualization illustrating the use of a specific embodiment of one aspect of the present invention. FIG. 1 shows a playground equipment 1 comprising an array structure 5 of first ropes 10 and intersecting second ropes 20, where the array structure 5 is suspended in three dimensions by a scaffold structure 300.

Figure 2:
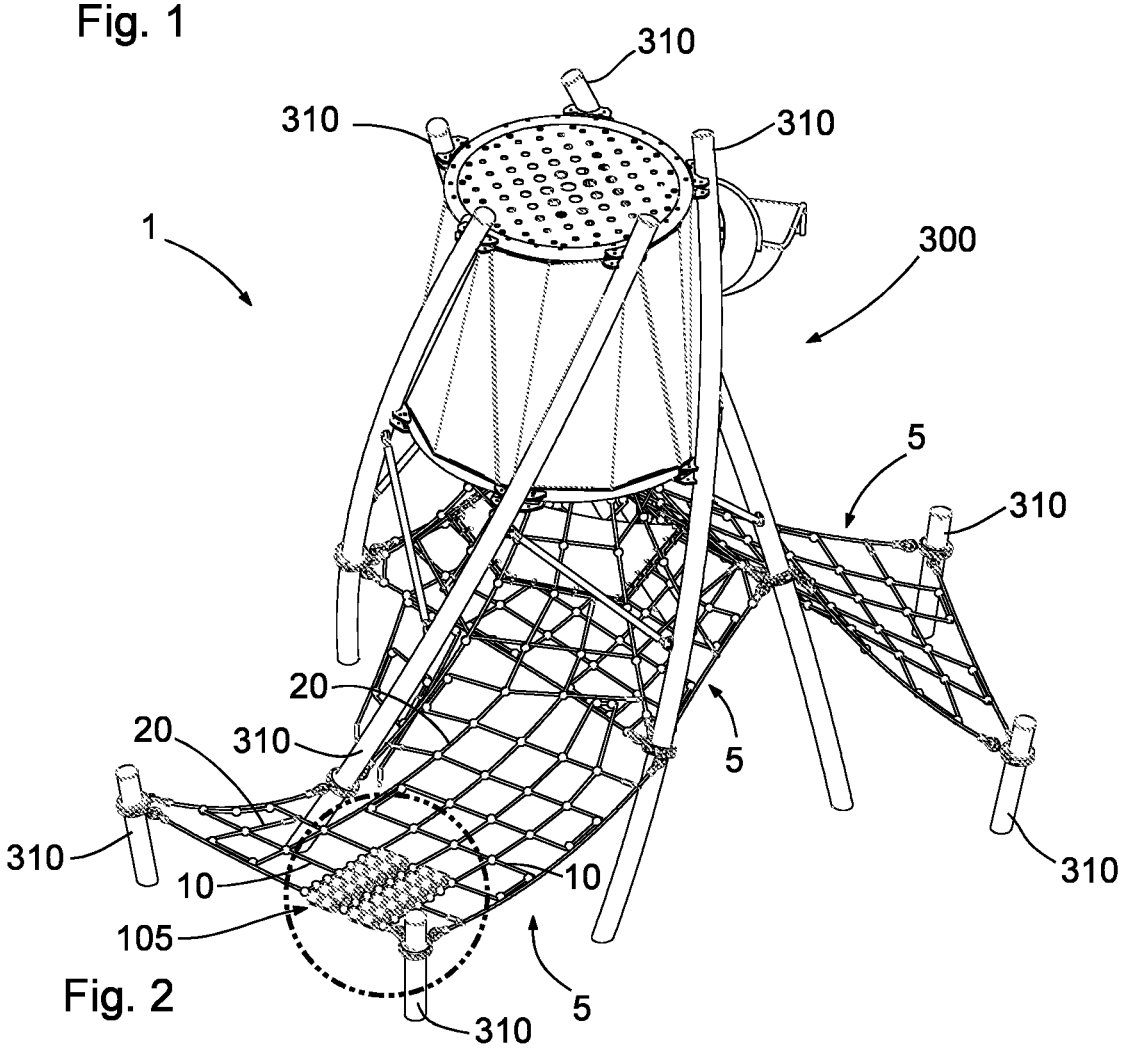
FIG. 2, in a perspective view, shows an outline of a playground equipment according to one aspect of the invention, the playground equipment comprising an array structure of networked ropes and a roll array section.

The scaffold structure 300 is configured for mounting the array structure 5 of networked ropes 10, 20 in a spread-out manner. The scaffold structure 300 may, as shown in FIGS. 1 and 2, comprise elements in the form of generally vertically arranged beams 310. In FIG. 2 such generally vertically arranged beams 310 are shown to be slightly curved, and forming an angle with respect to the ground. It will be appreciated that also straight beams may be utilized. It will also be appreciated that the scaffold structure may alternatively or additionally comprise other elements than vertical or slanted beams 310, such as plates and blocks (not shown) or any combination thereof. The scaffold structure 300 may optionally comprise further elements in the form of horizontally formed beams (not shown) connected between one or more of the previously mentioned elements. The array structure 5 of networked ropes 10, 20 may be spread out between combinations of the above mentioned elements.

Figure 5:
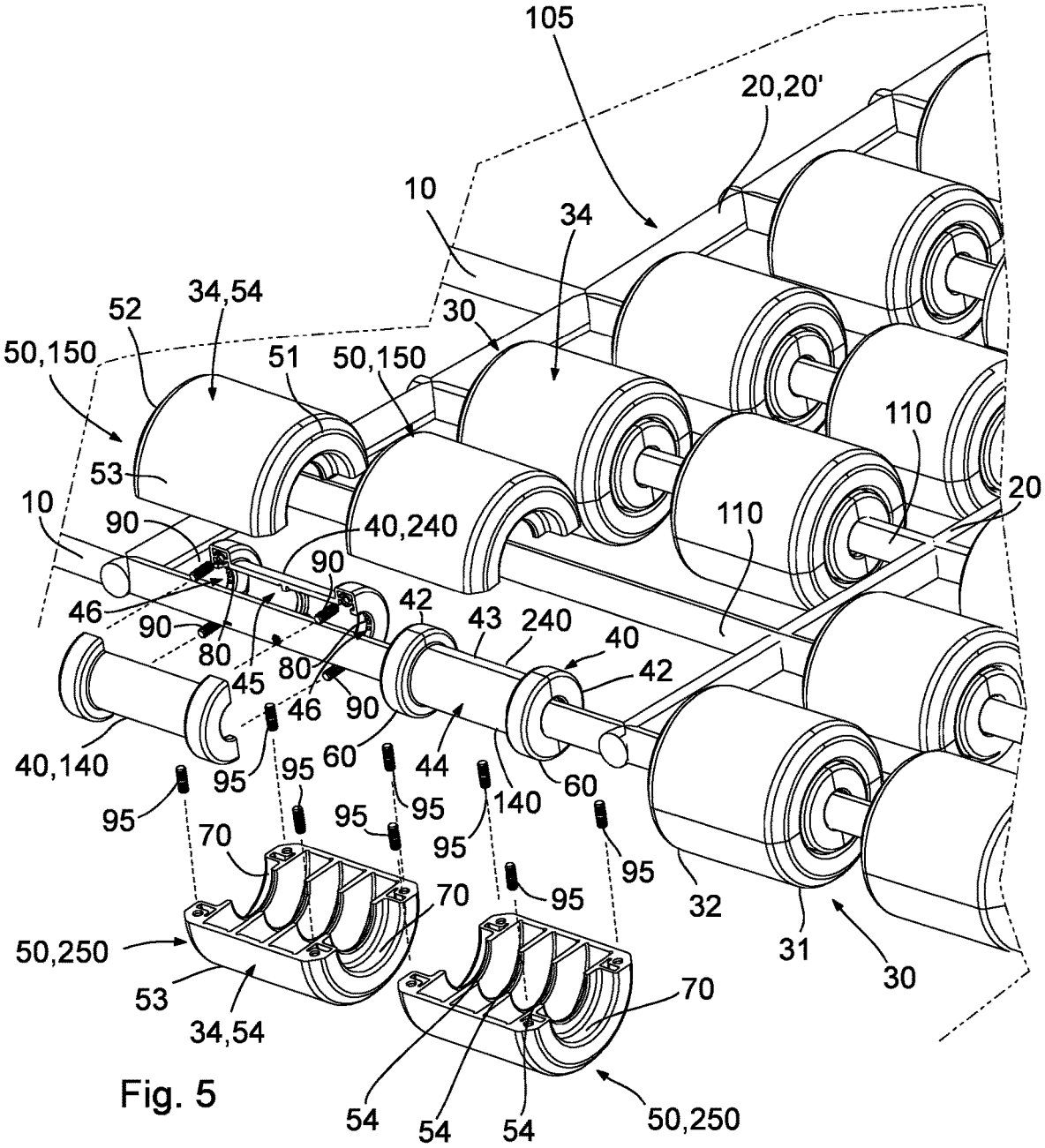
FIG. 5, in a perspective view, shows a portion of roll array section of an array structure of networked rope, and illustrating the assembly of a roll according to the invention.

The invention relates in a first aspect to a roll 30 for a playground equipment 1 as illustrated in FIG. 2. An embodiment of the roll 30 according to the first aspect of the invention is shown in FIG. 5. One or more rolls 30 according to the first aspect of the invention may be used in an array structure 5 of a playground equipment 1, for example as shown in FIGS. 1 and 2.

In a second aspect, the invention relates to an array structure 5 of networked ropes arranged in a rectangular array of parallelly arranged first ropes 10 and intersecting second ropes 20, where the array structure comprises one or more rolls 30 connected to a first rope 10 between two neighbouring second ropes 20. An embodiment of the array structure 5 according to this aspect of the invention is shown in detail in FIG. 3. The array structure 5 may be implemented in a playground equipment 1, such as illustrated in FIGS. 1 and 2.

Figure 3:
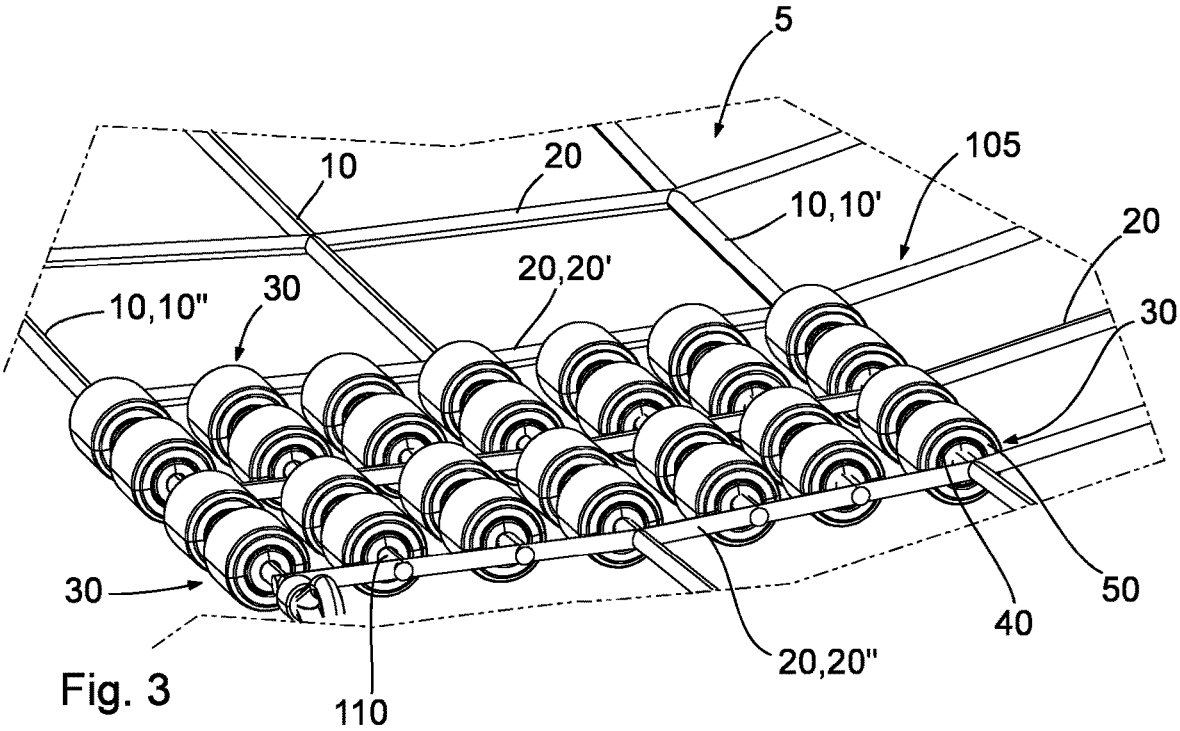
FIG. 3, in a perspective view, shows a portion of an array structure of networked ropes, with a roll array section, for a playground equipment according to the invention.
Figure 4:
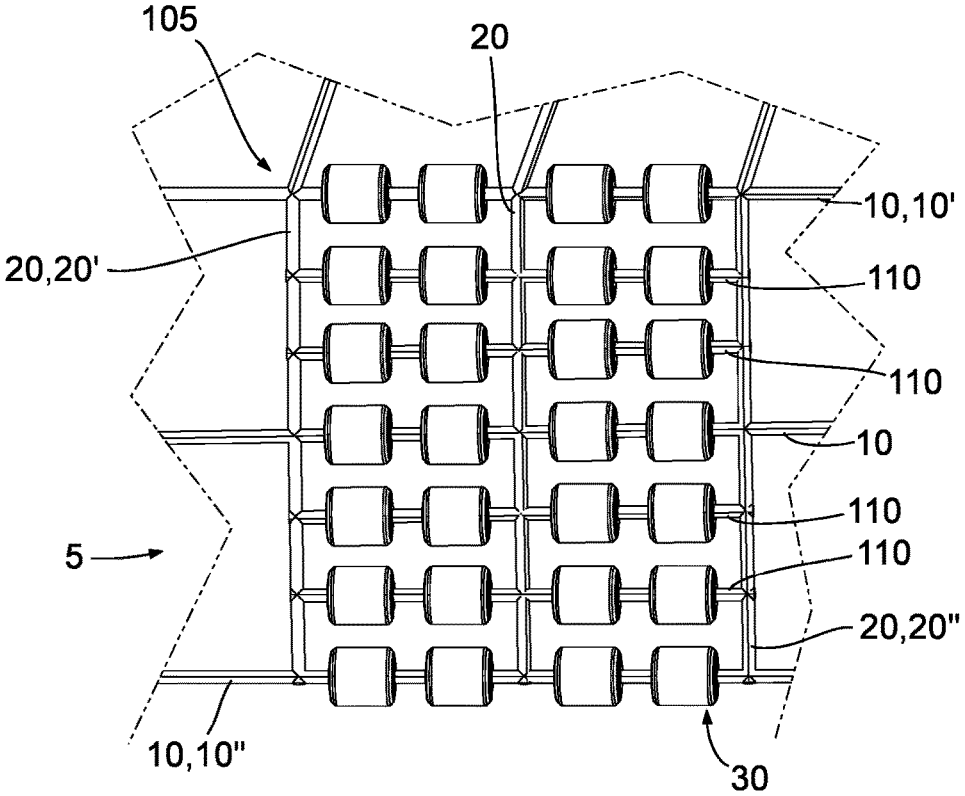
FIG. 4, in a top view, shows a portion of an array structure of networked ropes, with a roll array section, for a playground equipment according to the invention.

In a third aspect, the invention relates to an array section 105 for an array structure 5 of networked ropes arranged in a rectangular array of parallelly arranged first ropes 10 and intersecting second ropes 20, where the array section 105 comprises one or more rolls 30 connected to the first ropes 10 of the array section 105 between each pair of neighbouring second ropes 20 of the array section 105. An embodiment of such an array section 105 is illustrated in FIGS. 3 and 4. Such an array section 105 may form part of an array structure 5 according to the second aspect of the invention.

An array structure 5 comprising one or more such array sections 105 may form part of playground equipment 1, for example as shown in FIGS. 1 and 2, where the playground structure 1 is shown having one array structure 5 having one array section 105. It will be appreciated, that the array structure 5 in FIGS. 1 and 2 may have more than one array section 105, and that such array sections 105 may be distributed at different parts of the array structure.

Now turning to FIG. 5 each roll 30 comprises an inner clamping part 40 and an outer part 50.

The inner clamping part 40 of roll part comprises an elongate body 43 extending between a first end 41 of the inner clamping part and a second end 42 of the inner clamping part. The inner clamping part 40 of the roll 30 further has an outer surface 44. The outer surface 44 of the inner clamping part 40 is preferably generally cylindrical as shown—or comprises cylindrical portions (not shown)—in order to allow rotation of the outer part 50 relative to the inner clamping part 40.

The inner clamping part 40 of the roll 30 further comprises an inner surface 45. The inner surface 45 of the inner clamping part 40 is configured for receiving a first rope 10. For this purpose the inner surface 45 is generally cylindrical to conform to the generally cylindrical outer surface of a first rope 10. The inner surface 45 is dimensioned such that it generally has a diameter corresponding to a diameter of a first rope.

The inner clamping part 40 is configured for non-slideable fixation a first rope 10. Therefore, the inner surface 45 of the inner clamping part 40 is configured for clamping to a first rope 10.

The inner clamping part 40 may have one or more inner surface portions 46 configured for clamping to the first ropes 10. This may e.g. be obtained by the dimension of the one or more inner surface portions 46 being slightly smaller than the outer dimension of the first ropes (not shown). Thereby, the one or more surface portions 46 presses into the first rope 10 to prevent longitudinal displacement, when mounted on the first rope.

In other embodiments—and as shown in FIG. 5—the one or more inner surface portions 46 of the inner clamping part 30 comprise protrusions 80 configured for depressing portions of the first ropes 10 to prevent longitudinal displacement, when mounted on the first rope. In other embodiments (not shown), the entire inner surface 45 may be equipped with protrusions 80 to prevent longitudinal displacement, when mounted on the first rope.

The protrusions 80 are radially inwardly projecting. The protrusions may, as shown be knobs. In other embodiments, the protrusions may be needles, spikes or barbs.

As mentioned above, a roll 30, according to the invention, further comprises an outer part 50 attachable to the inner clamping part.

The outer part 50 comprises a generally cylindrical body 53, between a first end 51 of the outer part of roll and a second end 52 of the outer part 50 of the roll 30. The generally cylindrical body 53 of the outer part 50 comprises an outer surface 54. The outer surface 54 of the outer part 50 of the roll 30 is preferably cylindrical, as shown. Further, the outer surface 54 of the outer part 50 of the roll 30 is identical to an outer surface of the roll 34, when the inner clamping part 40 and the outer part 50 are assembled.

The outer part 50 of the roll 30 further comprises an inner surface 55. The diameter of the inner surface 55 of the outer part 50 is conjured to receive the body 43 of the inner clamping part 40 of the roll 30. As shown in FIG. 5, the inner surface 55 of the outer part 50 may be sectioned into inner surface portions. Thereby, the weight and material use may be reduced.

The inner clamping part 40 and the outer part 50 are in non-slideable connection relative to each other in a longitudinal direction of the roll 30, which is parallel to a longitudinal direction of the first rope 10 on which a roll 30 is mounted. Further, the outer part 50 is rotatable relative to the inner clamping part 40. Due to this arrangement, and as illustrated in FIGS. 1-5, the outer part 50 is rotatable about the longitudinal direction of the first rope 10 on which the roll 30 is mounted. It can also be said that the rotational axis of the outer part 50 is parallel to the longitudinal direction of the first rope 10 on which the roll 30 is mounted.

In an embodiment, the rotatable, but longitudinally stationary relationship between the inner clamping part 40 and the outer part 50 may be provided by the inner clamping part 40 comprising a circumferential bead 60, and the outer part comprising a mating annular recess 70 configured for cooperating with the circumferential bead 60 of the inner part 40. The circumferential bead 60 has a cylindrical outer surface configured for cooperating with the annular recess 70. In principle only one such pair of mating circumferential bead 60 and annular recess 70 may be sufficient (not shown). Such a single pair may for example be centrally located along a length of the inner clamping part and the outer part respectively (not show).

However, as shown in FIG. 5, in an embodiment, inner clamping part 40 of the roll 30 comprises a first circumferential bead 60 formed at the first end 41 of the inner clamping part 40 and a second circumferential bead 60 is formed at a second end 42 of the inner clamping part 40. Correspondingly, the outer part comprises a mating annular recess configured formed at the first end 51 of the outer part and configured for cooperating with the circumferential bead 60 formed at the first end 41 of the inner clamping part 40, and a mating annular recess 70 formed at the second end 52 of the outer part 50, which is configured for cooperating with the circumferential bead 60 formed at the second end 42 of the inner clamping part 40.

In FIG. 5 the beads 60 extend outwards from the outer surface 44 of the inner clamping part 40. In other—not shown—embodiments it will be appreciated that the bead may instead be formed as an inwardly extending protrusion from an inwardly facing surface of the outer part, and an annular recess may correspondingly be formed in the inner clamping part 40.

As also shown in FIG. 5, the inner clamping part 40 may comprise two interconnectable inner shell parts 140, 240, forming halves of the inner clamping part. In order to attach the inner clamping part 40 to a first rope 10, the inner shell parts 140, 240 may be squeezed together around the first rope 10 and connected to each other with barbed fasteners 90.

In principle the inner clamping part 40 may—in not shown embodiments—be formed by more than two inner shell parts 140, 240.

The inner clamping part of the roll may be made from two or more identically formed plastic injection moulded inner shell parts.

As also shown in FIG. 5, also the outer part 50 of a roll 30 comprises two interconnectable outer shell parts 150, 250, forming halves of the outer part.

In order to attach the outer part 50 to the inner clamping part 40, outer shell parts 150, 250 may be squeezed together around inner clamping part 40, e.g. formed by inner shell parts 140, 240, and connected to each other with barbed fasteners 95.

In principle the outer part 50 may—in not shown embodiments—be formed by more than two outer shell parts.

The outer part 50 of the roll 30 may be made from two or more identically shaped plastic injection moulded outer shell parts 150, 250.

The outer surface 34 of a roll 30 may comprise two or more surface sections 134, 234 formed in parallel to a longitudinal axis of the first ropes, each surface section 134, 234 having a different colour. Such differently covered surface sections 134, 234 may be provided by painting or providing the rolls 30 with a coating.

However, in some embodiments, where the interconnectable outer shell parts are injection moulded and formed in plastic, the differently coloured outer surface portions, may be provided by the two or more interconnectable outer shell parts 150, 250 being moulded in different colours.

Returning now to FIG. 2, one or more or rolls 30 as described above may be attached to an array structure 5. Such an array structure 5 may form part of a playground equipment 1. Rolls 30 may—in not shown embodiments—be distributed over the entire array structure 5, densely or less densely. In embodiments rolls 30 are clustered in one or more roll array sections 105. In FIGS. 1 and 2 one such roll array section 105 is shown. FIGS. 3 and 4 shows a detailed close up of the array section 105 of the array structure 5 encircled in FIG. 2.

Thus, in one embodiment, the array structure 5 of networked ropes 10, 20 arranged in a rectangular array of parallelly arranged first ropes 10 and intersecting second ropes 20 comprises a roll array section 105. The roll array section 105 is formed between a first end first rope 10' and a second end first rope 10" and a first side second rope 20' and a second side second rope 20". The first end first rope 10' and the second end first rope 10" and any first rope 10 formed there between comprises a roll 10 formed between each neighbouring second ropes 20 between the first side second rope 20' and the second side second rope 20". As shown in FIGS. 3 and 4, the roll array section 105 in this case only has one first rope 10 formed between the first end first rope 10' and the second end first rope 10", but it will be appreciated, that the roll array section 105 may comprise a plurality of first ropes 10 in between the first end first rope 10' and the second end first rope 10", whereby the roll array section 105 may be made longer.

In a preferred embodiment, and as also shown in FIGS. 3 and 4, two rolls 30 are connected to each first rope 10 between each neighbouring second ropes 20 of the roll array section 105. Instead of having one longer roll, two or more rolls 30 provides increased flexibility, and thereby reduces the risk of damaging or breaking the rolls 30.

As also shown in FIGS. 3 and 4 an intermediary third rope 110 may be formed between each neighbouring first ropes 10 of the roll array section 105, where each third rope 110 has at least one roll 30 formed between each neighbouring second ropes 20 of the roll array section 105. A single an intermediary third rope 110 may be formed between each neighbouring first ropes 10 of the roll array section 105. However, two or more intermediary third ropes 110 may be formed between each neighbouring first ropes 10 of the roll array section 105. In the embodiment shown in FIGS. 3 and 4, two intermediary third ropes 110 are formed between each neighbouring first ropes 10 of the roll array section 105.

In a preferred embodiment, and as also shown in FIGS. 3 and 4, two rolls 30 are connected to each third rope 110 between each neighbouring second ropes 20 of the roll array section 105. As above, instead of having one longer roll, two or more rolls 30 provides increased flexibility, and thereby reduces the risk of damaging or breaking the rolls 30.

Preferably, the number of rolls 30 connected to the third ropes 110 between each two neighbouring second ropes 20, is the same as the number of rolls connected to the first ropes 10 between each two neighbouring second ropes 20.

It is to be noted that the figures and the above description have shown the example embodiments in a simple and schematic manner. Many of the specific mechanical details have not been shown since the person skilled in the art should be familiar with these details and they would just unnecessarily complicate this description. For example, the specific materials used and the specific injection moulding procedure have not been described in detail since it is maintained that the person skilled in the art would be able to find suitable materials and suitable processes to manufacture the rolls according to the current invention.

PARTS LIST

1 playground equipment
5 array structure of networked ropes
10 first ropes of the array structure of networked ropes
10' first end first rope, first rope defining a first end of a roll array section
10" second end first rope, first rope defining a second end of a roll array section
20 second ropes of the array structure of networked ropes, arranged to intersect first ropes
20' first side second rope, second rope defining a first side of a roll array section
20' second side second rope, second rope defining a second side of a roll array section
30 roll
21 first end of roll
32 second end of roll
33 body of roll
34 outer surface of roll
40 inner clamping part of roll
41 first end of the inner clamping part
42 second end of the inner clamping part
43 body of inner clamping part of roll
44 outer surface of the inner clamping part
45 inner surface of the inner clamping part
46 inner surface portions
50 outer part of roll
51 first end of the outer part of roll
52 second end of the outer part of roll
53 body of outer part of roll
54 outer surface of the outer part of roll, identical to outer surface of roll
55 inner surface of the outer part of roll
60 circumferential bead formed on inner clamping part of roll
70 mating annular recess formed in the outer part of roll
80 protrusions formed in the inner surface of the inner clamping part
90 barbed fasteners
95 barbed fasteners
105 roll array section
110 third rope, intermediary third rope
140 inner shell part of inner clamping part of roll
150 outer shell part of outer part of roll
154 outer surface of the outer shell part of outer part of roll
240 inner shell part of inner clamping part of roll
250 outer shell part of outer part of roll
254 outer surface of the outer shell part of outer part of roll
300 scaffold structure
310 vertical beam

The invention claimed is:

1. A playground equipment comprising an array structure of networked ropes arranged in a rectangular array of parallelly arranged first ropes and intersecting second ropes and one or more rolls connected to a first rope, between two neighbouring second ropes wherein each of said one or more rolls comprises an inner clamping part configured for non-slideable fixation to the respective first rope, and an outer part attachable to the inner clamping part, wherein the inner clamping part and the outer part of a given roll are in non-slideable connection relative to each other in a longitudinal direction of said given roll, which is parallel to a longitudinal direction of the first rope on which said given roll is mounted and wherein the outer part is rotatable relative to the inner clamping part.

2. The playground equipment according to claim 1, wherein the array structure of networked ropes arranged in a rectangular array of parallelly arranged first ropes and intersecting second ropes comprises a roll array section formed between a first end first rope and a second end first rope and a first side second rope and a second side second rope, where said one or more rolls comprises one or more rolls formed on the first end first rope, one or more rolls formed on the second end first rope and one or more rolls formed on at least one first rope formed between the first end first rope and the second end first rope and where said one or more rolls formed on each first rope are formed between the first side second rope and the second side second rope.

3. The playground equipment according to claim 2, wherein the one or more rolls formed on each first rope comprises two rolls connected to each first rope between each neighbouring second ropes of the roll array section.

4. The playground equipment according to claim 2, wherein an intermediary third rope is formed between neighbouring first ropes and parallel to neighbouring first ropes of the roll array section, and where each third rope has at least one roll formed between each neighbouring second ropes of the roll array section.

5. The playground equipment according to claim 1, wherein the inner clamping part of each of the one or more rolls comprises two or more interconnectable inner shell parts.

6. The playground equipment according to claim 1, wherein the outer part of each of the one or more rolls comprises two or more interconnectable outer shell parts.

7. The playground equipment according to claim 1, wherein the inner clamping part of each of the one or more rolls comprises a circumferential bead or recess, and wherein the outer part of each of the one or more rolls comprises a mating annular recess or bead configured for cooperating with the circumferential bead or recess of the respective inner part.

8. The playground equipment according to claim 7, wherein the inner clamping part of each of the one or more rolls comprises a first circumferential bead formed at a first end of the inner clamping part and a second circumferential bead formed at a second end of the inner clamping part, and wherein the outer part comprises a mating annular recess configured for cooperating with the circumferential bead formed at the first end of the inner clamping part and a mating annular recess configured for cooperating with the circumferential bead formed at the second end of the inner clamping part.

9. The playground equipment according to claim 1, wherein an inner surface of the inner clamping part of each of the one or more rolls comprises protrusions configured for depressing portions of the first ropes.

10. The playground equipment according to claim 1, wherein an outer surface of each of the one or more rolls comprises two or more surface sections formed in parallel to a longitudinal axis of the first ropes, each surface section having a different colour.

* * * * *